US005826665A

United States Patent [19]

Truax et al.

[11] Patent Number: 5,826,665

[45] Date of Patent: Oct. 27, 1998

[54] SPRINKLER HEAD WITH STAMPED TRIGGER-MOUNTING ELEMENTS

[76] Inventors: Perin E. Truax, 329 144th Ave., Caledonia, Mich. 49316; James G. Retzloff, 4773 Grandwoods Dr., Lansing, Mich. 48917

[21] Appl. No.: 853,789

[22] Filed: May 9, 1997

Related U.S. Application Data

[63] Continuation-in-part of Ser. No. 335,645, Nov. 8, 1994, Pat. No. 5,628,367.

[51] Int. Cl.[6] ..... A62C 37/14

[52] U.S. Cl. ..... 169/38

[58] Field of Search ..... 169/37, 38, 39, 169/40, 41, 90

[56] References Cited

U.S. PATENT DOCUMENTS

| | | | |
|---|---|---|---|
| D. 251,128 | 2/1979 | Groos et al. | D23/214 |
| 269,930 | 1/1883 | Harris | 169/41 |
| 600,246 | 3/1898 | Grinnell | 169/37 |
| 873,651 | 12/1907 | Asmus | 169/40 |
| 998,574 | 7/1911 | Hamilton | 169/39 |
| 1,107,845 | 8/1914 | Sackett | 169/37 |
| 1,233,289 | 7/1917 | Thomson | 169/26 |
| 1,736,255 | 11/1929 | Doughty | 169/38 |
| 1,736,256 | 11/1929 | Doughty | 169/37 |
| 1,791,294 | 2/1931 | Ware | 239/222.17 |
| 1,836,528 | 12/1931 | Dyson | 169/37 |
| 1,919,235 | 7/1933 | Loepsinger | 169/39 |
| 2,004,833 | 6/1935 | Rowley | 169/38 |
| 2,076,483 | 4/1937 | Rowley | 239/498 |
| 2,502,754 | 4/1950 | Rowley | 169/38 |
| 2,528,063 | 10/1950 | Loepsinger | 169/38 |
| 3,698,483 | 10/1972 | Martin et al. | 169/37 |
| 3,776,472 | 12/1973 | Lock et al. | 239/591 |
| 3,802,510 | 4/1974 | Johnson | 169/19 |
| 3,904,126 | 9/1975 | Allard | 239/502 |
| 3,911,940 | 10/1975 | Johnson | 137/79 |
| 3,918,645 | 11/1975 | Mohler | 239/498 |
| 3,924,687 | 12/1975 | Groos | 169/19 |
| 4,108,419 | 8/1978 | Sturman et al. | 251/30.05 |
| 4,109,727 | 8/1978 | Job | 169/41 |
| 4,134,759 | 1/1979 | Yajima et al. | 419/17 |
| 4,136,740 | 1/1979 | Groos et al. | 169/39 |
| 4,167,974 | 9/1979 | Job | 169/38 |
| 4,217,961 | 8/1980 | Wotton | 169/41 |
| 4,417,626 | 11/1983 | Hansen | 169/37 |

(List continued on next page.)

FOREIGN PATENT DOCUMENTS

| | | | |
|---|---|---|---|
| 413606 | 12/1966 | Switzerland . | |
| 3032 | 11/1888 | United Kingdom | 169/41 |
| 765125 | 1/1957 | United Kingdom | 169/37 |

OTHER PUBLICATIONS

*Metals Handbook*, 9th ed., vol. 6, on welding, brazing, and soldering, published by the American Society of Metals, Copyright 1983, "Percussion Welding", pp. 740–742.

*Primary Examiner*—Andrew C. Pike
*Attorney, Agent, or Firm*—Van Dyke, Gardner, Linn & Burkhart, LLP

[57] ABSTRACT

A sprinkler head assembly has a stamped mounting element for supporting a thermally activated triggering member in a sprinkler head assembly, and a method forms the same. The mounting element comprises a central base including a seat for supporting the triggering member. A first pair of arms, having a longitudinal extent, extend from a first face of the base at an angle less than 180 degrees. A second pair of arms, having a longitudinal extent, extend from the first face of the base at an angle less than 180 degrees. The longitudinal extent of at least one of the arms is greater than the longitudinal extent of the other arms to define a recess for cooperatively engaging the sprinkler head assembly. The mounting element is stamped from generally planar stock to form arms having varied lengths and, thus, create a saddle-shaped recess that slidably mounts on a frame of the sprinkler head assembly. The mounting element is preferably formed by progressive stamping techniques and accommodates various dimensions and tolerances of the sprinkler head frame and thermally responsive triggering member.

28 Claims, 3 Drawing Sheets

U.S. PATENT DOCUMENTS

| | | | |
|---|---|---|---|
| 4,494,701 | 1/1985 | Hensley et al. | 239/585.4 |
| 4,570,720 | 2/1986 | Retzloff et al. | 169/39 |
| 4,623,023 | 11/1986 | Retzloff et al. | 169/39 |
| 4,630,682 | 12/1986 | Pieczykolan | 169/38 |
| 4,836,291 | 6/1989 | Owens et al. | 169/46 |
| 4,898,246 | 2/1990 | Riedle et al. | 169/38 |
| 4,981,179 | 1/1991 | Klein | 169/38 |
| 4,993,496 | 2/1991 | Riedle et al. | 169/38 |
| 5,010,959 | 4/1991 | Lostoski | 169/37 |
| 5,020,601 | 6/1991 | Retzloff et al. | 169/37 |
| 5,094,298 | 3/1992 | Polan | 169/41 |
| 5,195,592 | 3/1993 | Simons | 169/37 |

SPRINKLER HEAD WITH STAMPED TRIGGER-MOUNTING ELEMENTS

TECHNICAL FIELD AND BACKGROUND OF THE INVENTION

This is a continuation-in-part of patent application Ser. No. 08/335,645 entitled TEMPERATURE SENSITIVE SPRINKLER HEAD WITH IMPROVED SPRING filed on Nov. 8, 1994 which has now issued as U.S. Pat. No. 5,628,367.

The present invention relates to sprinkler heads used in automatic fire extinguisher systems for buildings and the like, and, in particular, relates to automatic sprinkler heads having a triggering element used to initiate the opening of the fluid flow orifice of the sprinkler head.

Sprinkler heads have long been used in automatic fire extinguishing systems for buildings in order to disperse a fluid to suppress and extinguish fires. Typically, the fluid utilized in such systems is water, although systems have also been developed to disperse foam and other materials. Historically, sprinkler heads include a solid metal base that is connected to a pressurized supply of water, and some type of deflector to distribute the water flow in a spray over the controlled area. The deflector is typically spaced from the outlet of the base by a frame, and a triggering mechanism secures a seal over the base outlet. When the ambient temperature about the sprinkler is raised to a sufficiently increased temperature, such as the result of a fire, the triggering mechanism releases the seal and water flow is initiated.

A variety of different triggering mechanisms have previously been used. Two common triggering mechanisms incorporate either a frangible bulb or a fusible link. The fusible link includes a temperature sensitive linkage that is braced between the seal and frame. Upon reaching a predetermined temperature level, the fusible link separates and permits the water pressure to open the seal. Frangible bulb triggering mechanisms typically include a sealed glass bulb that is at least partially filled with a temperature responsive fluid, and normally a liquid. The glass bulb is, likewise, braced between the seal and the frame. When the surrounding temperature raises to a predetermined level, the encapsulated fluid expands and bursts the frangible bulb. Once the frangible bulb is removed, the pressurized fluid forces the seal open in order to initiate water delivery to the protected area. Such frangible bulbs normally include an elongated, fragile tip which is easily damaged and must be accommodated in the triggering mechanism. Conventional sprinkler heads accommodate the fragile tip of the glass bulb by orienting the tip to project toward or into the waterway in the sprinkler base.

Sprinkler heads are typically cast and carefully machined in order to minimize dimensional variation and irregularities which would otherwise overstress or unevenly stress the frangible bulb and potentially lead to premature failure. However, the frangible bulb normally includes dimensional variations which make it difficult to adequately control assembly tolerances even if the dimensional variation in the base is controlled. One solution to this problem is to include a bulb-supporting adjustment screw on the base or on an integral frame supported on the base so that dimensional variation in the frangible bulb and in the base can be taken up by the adjustment screw. However, the adjustment screw and the structure on the base for receiving the adjustment screw add cost and complexity to the sprinkler head. Further, machining the base adds costly additional manufacturing steps, and results in scrap material and waste during the machining process.

Stamping techniques have been previously employed to manufacture certain industrial products and components. In some instances, the stamping of parts from sheet stock can be quicker and less laborious than casting the part, particularly when subsequent machining of the cast part may be required. Conventional stamping techniques, however, require a part to have recesses that are relatively shallow as compared to the recess opening in order to allow the stamping die to fit into and form the recess. Conventional stamping techniques, thus, in many instances are unable to produce parts having recesses which are as deep as can be formed by casting or by casting and machining the part. While certain stamping equipment and techniques referred to as deep-draw stamping can form a part recess that is relatively deep in relation to the recess opening, such deep-draw stamping equipment and techniques are relatively expensive and not as widely employed as conventional stamping. Another known form of stamping equipment and technique is referred to as progressive stamping, which involves subjecting stock to a progression of dies that ever increasingly form the stock toward the finished form.

SUMMARY OF THE INVENTION

The present invention includes a mounting element for a sprinkler head triggering mechanism, a sprinkler head incorporating the mounting element, and a method of manufacturing the triggering mechanism mounting element. The mounting element includes a base with two spaced, elongated sidewalls and two spaced shorter sidewalls which cooperate to form a saddle that seats on the frame of the sprinkler head. The mounting element's base defines an aperture or recess which receives and seats the end of a triggering mechanism. Preferably, in the case of a frangible bulb triggering mechanism with a fragile elongated tip, the mounting element recess is an aperture which receives the frangible bulb tip. Preferably, in the instance of a fusible link, the seating recess is a recess or groove which abuttingly receives the end of the frangible link. In the preferred sprinkler head, the saddle-shaped mounting element orients the fragile tip of a glass bulb to extend toward the frame and deflector, away from the base.

Preferably, the mounting element is formed by stamping techniques from a blank cut from a sheet of stock. The blank is formed so as to have two elongated arms and two shorter arms joined by a central web. Most preferably, the blank is progression stamped so as to bend the arms into saddle-forming sidewalls, and a seating aperture is cut or a seating recess stamped into the central base web.

With the present invention, a deeply elongated, saddle-shaped mounting element can be formed by a stamping process. The invention greatly reduces the cost and difficulties involved in casting, machining, or otherwise forming a mounting element for the triggering mechanism. The mounting element of the present invention accommodates the dimensional irregularities of the triggering mechanism in a relatively inexpensive and easily manufactured structure.

These and other features and advantages of the present invention will be further understood and appreciated by those skilled in the art by reference to the following specification, claims, and drawings.

DESCRIPTION OF PRIOR ART SPRINKLER HEAD

Figure 10:
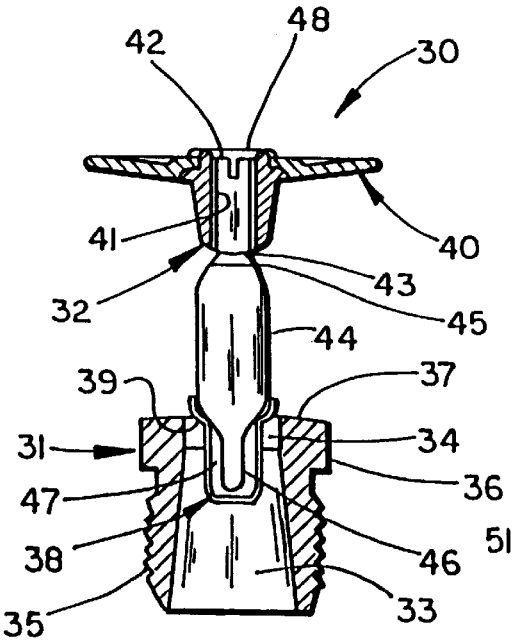
PRIOR ART FIG. 10
FIG. 10 is a side cross-sectional view of a sprinkler head in the prior art.

A prior art sprinkler head 30 (FIG. 10) includes a solid metal base 31, such as brass, and an integral cast-in-place U-shaped arch or frame 32. Base 31 includes a passageway 33, which extends through base 31 and defines an outlet opening 34. The exterior of base 31 includes a plurality of machined threads 35, for threadably engaging a conduit which supplies a pressurized source of water, and a shoulder 36, which provides an engagement surface for a wrench for applying a torque to base 31. A ring-shaped recess 37 is machined into base 31 at outlet opening 34, and a cup-shaped member 38 including a ring-shaped seal 39 fits mateably over outlet opening 34 with seal 39 sealingly engaging ring-shaped recess 37. A deflector 40 is provided and attached to frame 32, which arches over outlet opening 34 of the passageway 33, for deflecting water flowing out of opening 34 into an optimal pattern. Frame 32 includes a threaded hole 41, which is generally aligned over outlet opening 34, and a screw 42, which extends through threaded hole 41. The distal end of screw 42 extends through threaded hole 41 and includes a pocket 43 formed therein. A conventional frangible bulb 44 is positioned between cup-shaped member 38 and screw 42. Bulb 44 includes a rounded end 45 that mateably engages pocket 43 in screw 42 and further includes an irregular end 46 that mateably extends into a space 47 within cup-shaped member 38. By adjusting screw 42, the amount of compression on bulb 44 can be adjusted to a predetermined level. An anaerobic adhesive 48 fills threaded hole 41 to prevent movement of screw 42 once the compressive force on bulb 44 is adjusted to a desired amount.

DETAILED DESCRIPTION OF PREFERRED EMBODIMENTS

Figure 1:
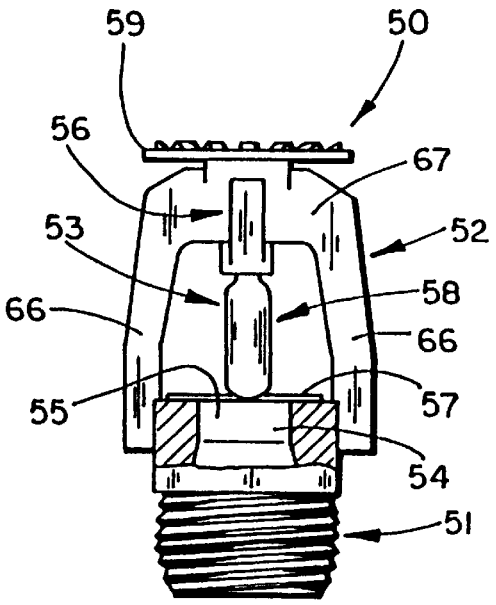
FIG. 1 is a side, partially cross-sectional view of a sprinkler head incorporating the present invention.
Figure 2:
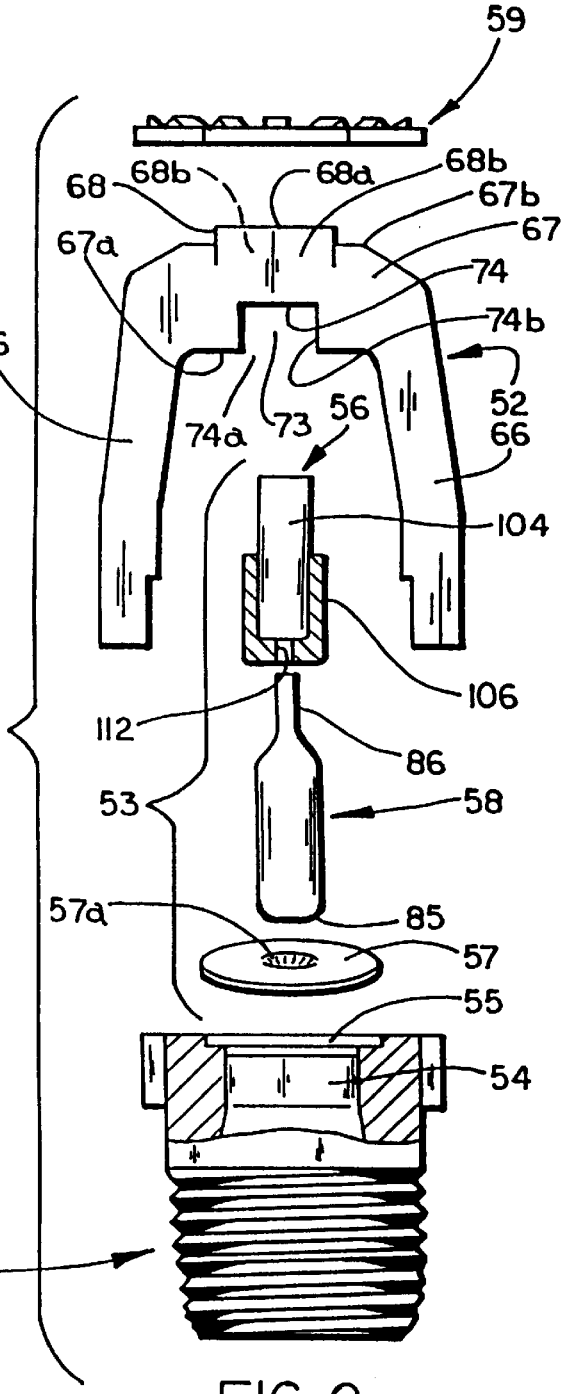
FIG. 2 is an exploded side, partially cross-sectional view of the sprinkler head shown in FIG. 1.

In the preferred embodiment, the present invention is embodied in a sprinkler head with a mounting for a temperature-responsive element and method of manufacturing the mounting by stamping, a preferred form of which is shown in FIGS. 1 and 2 and referenced generally at 50. Sprinkler head 50 includes a base 51, which is threaded for connection to a pressurized water source, a U-shaped metal frame 52, and a thermally activated triggering apparatus 53 which is mounted between frame 52 and base 51. Base 51 includes a bore that extends through base 51 and defines a fluid passageway 54 with an outlet opening 55. Triggering apparatus 53 includes a mounting element or pip 56, a sealing disk 57, and a thermally activated triggering member 58. Thermally activated triggering member 58 is mounted between frame 52 and base 51 on mounting element 56, which engages frame 52, and on disk 57, which sealingly engages and closes outlet opening 55 to thereby form triggering apparatus 53. A deflector 59 is mounted on frame 52 opposite outlet opening 55 so as to be positioned in the path of the fluid flow from passageway 54 when disk 57 is dislodged.

As best seen in FIG. 2, frame 52 includes a joining web 67 and a pair of elongated arms or portions 66 that extend from web 67 and are integrally connected by web 67. Joining web 67 includes a channel-shaped recess 73 on an inner surface 67*a* of web 67, which forms a mounting element notch, and a raised landing 68 on an outer surface 67*b* of web 67 opposite from the mounting element notch. Channel-shaped recess 73 includes spaced-apart planar side walls 74*a* and 74*b* and a bottom wall 74 that extends between side walls 74*a*, 74*b* and extends transversely across joining web 67, facing outlet opening passageway 54. Raised landing 68 provides a generally planar mounting surface 68*a* for deflector 59 and includes opposed planar sides 68*b*. Deflector 59 is mounted on planar surface 68*a* of raised landing 68 of frame 52 so that when the outlet opening is uncovered the water from the pressurized water source will be directed to deflector 59, which is positioned in the path of the flowing water and deflects and disperses the water in a desired pattern.

In the illustrated embodiment shown in FIG. 2, thermally responsive triggering member 58 comprises a frangible glass bulb that encapsulates a thermally expansible fluid. When exposed to high temperatures, the thermally expansible fluid inside the glass bulb expands and causes the bulb to break. Preferably, triggering member 58 is generally cylindrical in shape and includes a rounded smooth end 85 for engaging sealing disk 57 and an opposite fragile irregular end or tip 86 that protrudes along the central longitudinal axis of triggering member 58 and extends into mounting element 56, as will be more fully explained. Preferably, sealing disk 57 includes a recess 57*a* for engaging and seating rounded end 85. Triggering member 58 is constructed so as to rupture at a predetermined ambient temperature associated with fires as a result of pressure from the expanding encapsulated fluid. Glass bulb triggering elements are commonly known and are commercially available in the industry. Further description of sprinkler head 50 and its components may be found in our U.S. patent application entitled TEMPERATURE SENSITIVE SPRINKLER HEAD WITH IMPROVED SPRING Ser. No. 08/335,645, filed Nov. 8, 1994, by Perin E. Truax and James G. Retzloff, now U.S. Pat. No. 5,628,367, the disclosure of which is herein incorporated in its entirety by reference.

Figure 3:
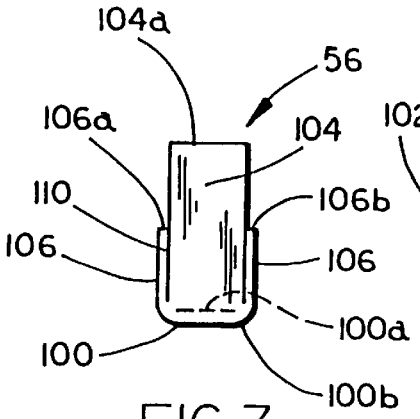
FIG. 3 is a side view of the triggering mechanism mounting element embodying the invention and shown in FIG. 1.
Figure 4:
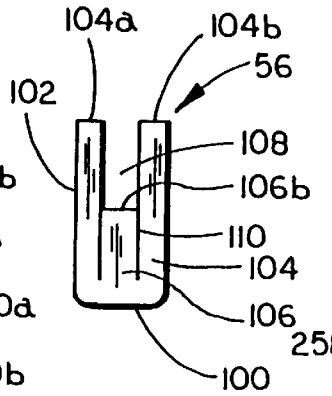
FIG. 4 is another side view of the mounting element of FIG. 3.

As best seen in FIGS. 3 and 4, in one preferred form, mounting element 56 includes a generally planar central base 100 defining first and second faces 100*a* and 100*b*. A generally tubular member 102 extends from first face 100*a* of central base 100 to define a recess into which tip 86 of sensitive member 58 extends. Tip 86 is typically about 0.236 inches in length with a variation of about 0.04 inches. In some applications the length of tip 86 may be about 0.316 inches with a similar variation. It should be understood that the dimensions of the bulb may vary depending on the application; therefore, these dimensions are provided for reference. Member 102 is formed from four arrayed arms or portions that are varied in length and bent upward from and joined with base 100 by respective bends. A pair of diametrically opposite long arms or portions 104 extend with a first longitudinal extent from opposite sides of base 100. A pair of diametrically opposite shorter arms or portions 106 similarly extend with a second longitudinal extent from opposite sides of base 100 and are interposed between long arms 104 to form tubular member 102. Arms 104, 106 are bent so as to be closely adjacent, with each arm preferably abutting the next adjacent arm 104 or 106. When bent upwardly from base 100, distal end portions 104*a*, 104*b* of long arms 104 extend above distal ends 106*a*, 106*b* of short arms to define an extended portion of tubular member 102. Consequently, a generally saddle-shaped mounting element is formed, which defines a saddle recess 108 between the distal end portions of long arms 104 and above distal ends 106*a*, 106*b* of shorter arms 106.

Mounting element 56 is mounted on frame 52 in channel-shaped recess 73 so that long arms 104 slide over the planar sides 68*b* of landing 68 and short arms 106 partially extend into recess 73. The distance between side walls 74*a* and 74*b* of notch 73 is, therefore, preferably slightly greater than the width of long arms 104 and approximately equal to the width of base 100 so that arms 104, 106 and the resulting saddle recess 108 cooperate with the mounting element recess to releasably couple mounting element 56 to web 67 of frame 52 when sprinkler head 50 is assembled. In this manner, distal end portions 104*a* and 104*b* of long arms 104 extend adjacent the sides of web 67 and engage planar sides 68*b* of raised landing 68, and short arms 106 extend and abut bottom wall 74 of recess 73 to form an interlocking arrangement with frame 52. Consequently, short arms 106 space central base 100 from frame 52 and, thereby, define a cavity or recess into which tip 86 of trigger member 58 extends, as will be explained below. The cavity is preferably slightly greater than the length of tip 86 in order to prevent the tip from striking frame 52. For example, the cavity is preferably about 0.25 inches deep for a bulb having a tip dimension of about 0.236 inches. This depth of cavity or recess can not be achieved using conventional stamping techniques and would normally require deep draw stamping. The present invention provides a method of forming mounting element 56 using a progressive stamping machine and eliminates the need for deep draw stamping as will be more fully described below.

Figure 5:
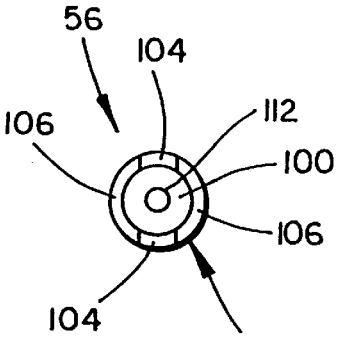
FIG. 5 is an end view of the mounting element of FIG. 3.

As best seen in FIGS. 2 and 5, central base 100 is preferably substantially planar and includes an aperture 112. Aperture 112 is dimensioned so as to receive irregular end or tip 86 of trigger member 58 and to provide a seat for trigger member 58 on central base 100, which abuts the broadened shoulder of the bulbous body of trigger member 58. Shorter arms 106 have sufficient length so that the bulb's irregular end 86 does extend into saddle recess 108. In this manner, when mounting element 56 is seated in the mounting recess of frame 52, tip 86 of trigger member 58 does not contact bottom wall 74 of notch 73. Consequently, the length of short arms 106 may be used to space the bulb 58 from frame 52. Furthermore, shorter arms 106 provide a means for spacing and thermally isolating the bulb trigger member 58 from mounting frame 52 while providing support to trigger member 58 from frame 52. Moreover, mounting element 56 may be formed from less thermally conductive material than frame 52 to further thermally isolate trigger member 58 from frame 52.

As shown in FIG. 5, arms 104, 106 may be generally arcuate in cross section, so as to cooperate in forming a cylindrical tubular member (102). Alternatively, arms 104, 106 may be generally planar in cross section, so that tubular member 102 is a generally rectangular or square-shaped tubular member. A seam or joint 110 is formed between the leading edges of abutting arms 104, 106 (FIGS. 3 and 4). In the illustrated embodiment, the leading edges of arms 104, 106 are not joined. However, it should be understood that the leading edges of arms 104 and 106 may be welded or otherwise secured to provide a more rigid mounting element.

Figure 6:
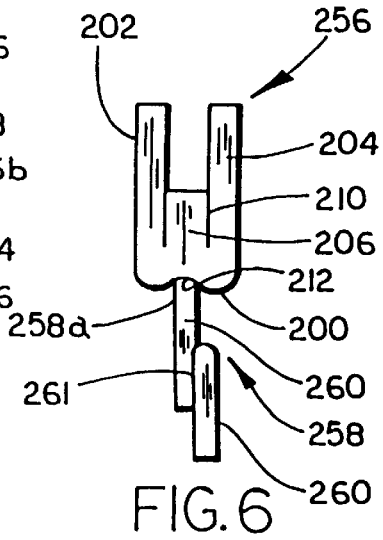
FIG. 6 is a side, fragmentary view of an alternative triggering mechanism and alternative preferred mounting element.

An alternative preferred embodiment is shown in FIG. 6 in which a mounting element or pip 256 is used to mount a fusible link, trigger member 258. Alternative mounting element 256 similarly includes a central base 200 and a diametrically opposed and spaced pair of long arms 204 and a diametrically opposed and spaced pair of short arms 206, which extend upwardly from base 200. Arms 204, 206 cooperate to form a generally cylindrical tubular member 202, with each of the adjacent arms forming seams 210. Alternatively, arms 204, 206 may be generally planar, and tubular member 202 may be rectangular or square in cross section. Stamped into central base 200 is a mounting recess or notch 212. Recess 212 serves as a seat for a first free end 258*a* of trigger member 258.

In the illustrated embodiment, trigger member 258 comprises a fusible link which is formed from two link plates 260 which are joined by a conventional thermally responsive material 261 as is known in the industry. Mounting element 256 is formed from a blank and most preferably stamped in a progression stamping machine, similar to the process that is described below, with mounting recess 212 being stamped during one of the progressive stamping steps.

Figure 7:
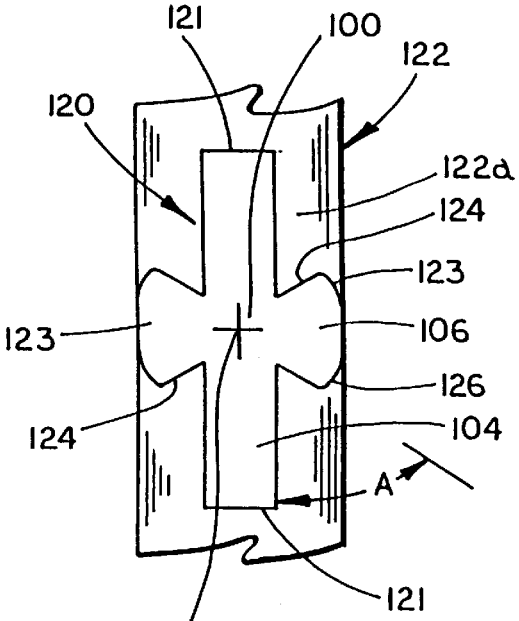
FIG. 7 is a plan view of a blank used in the manufacture of a preferred embodiment of the mounting element shown in FIG. 3.

Mounting elements 56 and 256 are preferably manufactured by an automated stamping press, such as a progressive die press or an in-line transfer die press. This type of stamping is far easier to perform and much less expensive than deep drawing stamping, for example. In describing the process, reference will be made to mounting element 56. But, it should be understood that the same or similar process can be used for mounting element 256. As best seen in FIG. 7, mounting element 56 is formed from a blank 120 that is stamped from a sheet of generally planar metal stock 122. Blank 120, therefore, has a generally uniform thickness throughout. Most preferably, blank 120 is stamped from stock 122 using a progressive stamping press. In this manner, blank 120 is left within the web or strip 122*a* of stock 122 until all the stamping steps are complete. Thus web 122*a* is used to transport blank 120 through the stamping process. Furthermore, the use of blank 120 allows use of a less expensive, common metal, such as typical annealed grade metal. A draw quality or deep draw quality material is not required.

Referring to FIG. 7, blank 120 includes a generally central area for forming planar central base 100 and four generally planar panels that ultimately comprise arms 104, 106. Blank 120 is generally cross-shaped, with a pair of opposed rectangular panels 121 that form long arms 104 and a pair of cross panels 123 that form shorter arms 106. Each cross panel 123 includes divergent leading edges 124, which diverge away from central base 100, and a radiused outer edge 126 joining divergent leading edges 124. Divergent leading edges 124 form an angle A with the leading edges of long arms 104. Divergent leading edges 124 extend along axes that are spaced and parallel to the center 120*a* of central base 100. When arms 104, 106 are bent so as to form tubular member 102, the magnitude of angle A and the degree of radiusing of radiused edge 126 compensate for the material making up the arcuate shape of tubular member 102.

Figure 8:
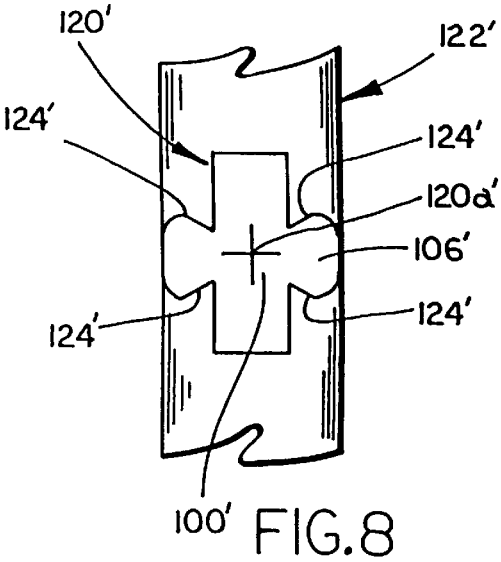
FIG. 8 is a plan view of an alternative blank used in forming an alternative preferred embodiment of the mounting element shown in FIG. 3.

As best seen in FIG. 8, angle A can be varied depending on the dimensional requirements of mounting element 56. Stock 122' includes a blank 120' having arms or portions 106' with leading edges 124' that extend along an axis that passes through center 120*a'* of a central base 100'.

Figure 11:
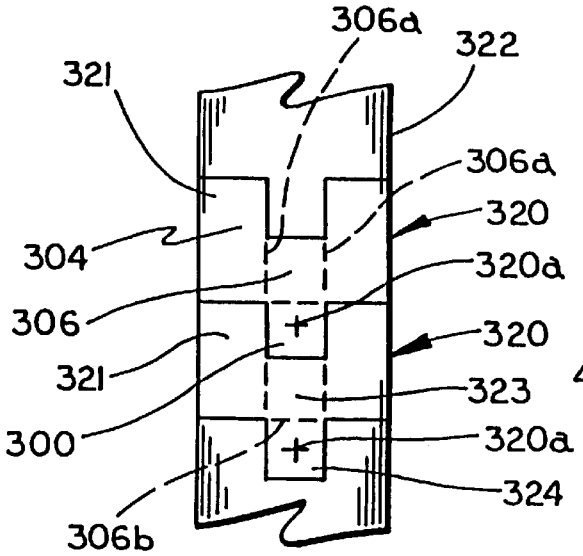
FIG. 11 is a plan view of a blank used in forming a third embodiment of the mounting element.

In another embodiment shown in FIG. 11, a blank 320 for forming the mounting element may include a central portion 323 for forming a short arm or portion 306 and a pair of opposite rectangular, planar panels 321 for forming long arms or extended portions 304. Long arms 304 extend along sides 306*a* of short arm 306 and are formed when they are stamped to bend about sides 306*a*. Blank 320 further includes a tab 324 which extends from side 306*b* of short arm 306 to form central base 300 with a center point 32*a*. In this configuration, blank 320 can be arranged in a compact arrangement on stock 322 to minimize the amount of material waste.

Figure 12:
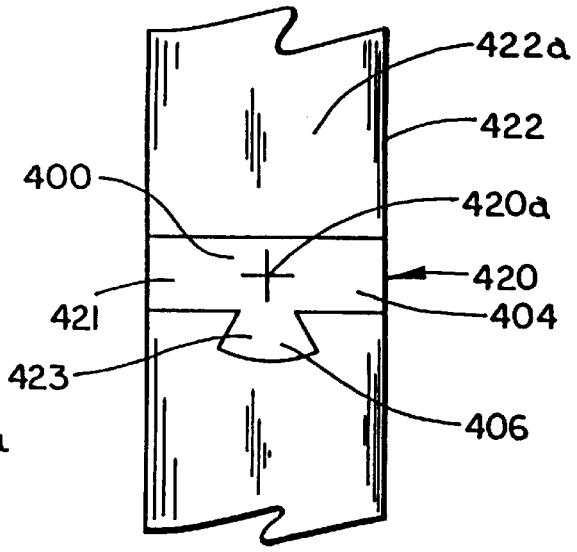
FIG. 12 is a plan view of a blank used in forming a fourth embodiment of the mounting element.
Figure 13:
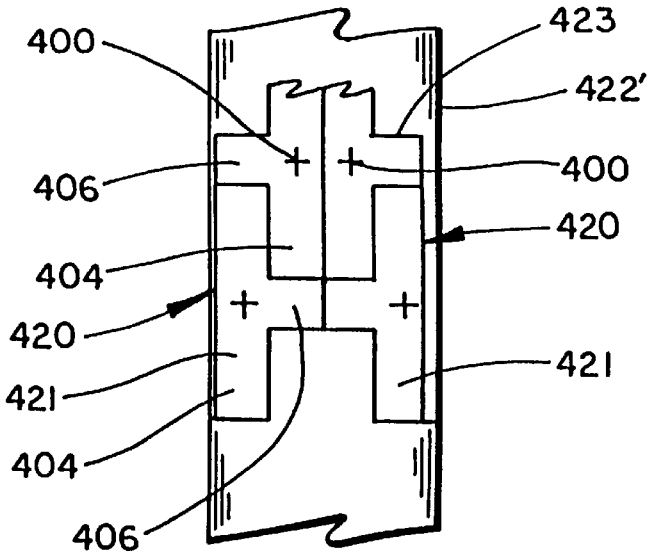
FIG. 13 is a plan view of a blank used in forming a fifth embodiment of the mounting element.

In other forms, the mounting element can be formed from a blank 420 having a pair of long arms or extended portions 404 and one shorter arm or portion 406 (FIG. 12). Blank 420 includes a central area for forming central base 400 with a center point 420*a* and a pair of opposed rectangular panels 421 for forming long arms or extended portions 404. Blank 420 further includes a tab 423 for forming shorter arm or portion 406. The mounting member is similarly formed by the progressive stamping machine wherein blank 420 is left within the web 422*a* of stock 422 until all the stamping steps are complete. When stamping blank 420 from a strip of stock 422, orientation of the blank can be rotated such that the blanks can be positioned in a more compact arrangement on the stock 422. Referring to FIG. 13, a plurality of blanks 420 are arranged in a back to back and front to front arrangement to maximize the use of sheet stock 422'.

Figure 9:
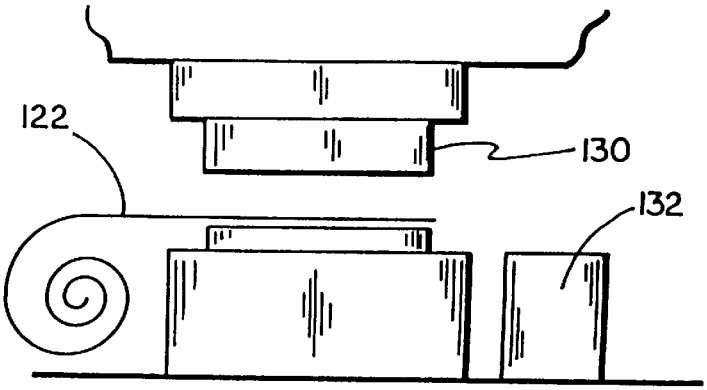
FIG. 9 is a schematic view of a stamping process incorporating the present invention.

As stated above, in forming the mounting element, sheet stocks 122, 122', 322, 422, and 422' are preferably stamped in a progressive stamping machine 130 (FIG. 9). A coiled source of sheet stock 122, 322, 422, or 422' feeds the continuous web between the dies of progressive stamping machine 130. As the web of stock 122, 322, 422, or 422' enters the stamping machine 130, the various cuts forming blanks 120, 320, and 420 are cut into the stock. The continuous webbing carries the respective blank 120, 320, or 420 to the next stamping stage. For example, blank 120 is preferably subjected to a series of six progression stampings in order to form the respective arms 104, 106 into the final saddle-shaped, mounting element 56. During stamping, arms 104, 106 are thus bent out of the plane of central base 100 and, most preferably, bent to an angle of about 90 degrees relative to base 100. End aperture 112 is die cut into central base 100 and, preferably, cut in the last progression stamping. Once mounting element 56 is finally formed through the progression stamping process, the finalized mounting element 56 is directed to the collecting assembly 132. It can be understood that blanks 220, 320, and 420 are subject to six or less progression stampings to achieve their respective configurations.

It will be understood by those skilled in the art that the above is a description of the preferred embodiments and that various modifications and changes may be made without departing from the spirit of the invention disclosed herein. The breadth of protection afforded is to be determined by the claims which follow and the scope of protection that the law allows.

The embodiments of the invention in which we claim an exclusive property or privilege are as follows;

We claim:

1. A mounting element for mounting a thermally activated triggering member in a sprinkler head assembly, the sprinkler head assembly including a base being and a frame, the base being for connecting to a pressurized source of water, the frame being secured to the base, and the thermally activated triggering member being supported between the base and the frame, said mounting element comprising:

a central base having a first face and a second face and including a seat for supporting the triggering member; and a tubular member extending from said first face of said central base and for spacing said central from the frame, and said tubular member having a pair of extended portions forming a saddle-shaped configuration for straddling and cooperatively engaging the frame.

2. The mounting element of claim 1, wherein said tubular member comprises a cylindrical tubular member.

3. The mounting element of claim 1, wherein said tubular member comprises at least two arms, said arms extending from said first face of said central base.

4. The mounting element as defined in claim 1, wherein said central base is substantially planar and said extended portions are each joined to said base by a bend.

5. The mounting element as defined in claim 1, wherein said central base further includes an aperture for receiving a portion of the thermally activated triggering member.

6. The mounting element as defined in claim 5, wherein said tubular member defines a cavity for receiving a second portion of the thermally activated triggering member.

7. The mounting element as defined in claim 6, wherein said tubular member has a portion for spacing said central base and thermally isolating the thermally activated triggering member from the frame.

8. The mounting element as defined in claim 1, wherein said seat comprises a recess for seating a portion of the triggering member on said central base.

9. A mounting element adapted to mount a thermally activated triggering member in a sprinkler head assembly, said mounting element comprising:

a central base having a first face and a second face, said base including a seat for supporting the triggering member;

a first arm and a second arm, each of said arms having a longitudinal extent and extending from said first face at an angle less than 180 degrees; and a third arm having a longitudinal extent and extending from said first face at an angle less than 180 degrees, the longitudinal extent of at least one of said first arm, said second arm, and said third arm being greater than the longitudinal extent of at least one of another of said first arm, said second arm, and said third arm to define a recess for cooperatively engaging the sprinkler head assembly.

10. The mounting element as defined in claim 9, wherein said first arm, said second arm, said third arm, and said central base are of generally uniform thickness and said arms are each joined to said central base by a bend.

11. The mounting element of claim 9, wherein said longitudinal extents of said first arm and said second arm are greater than the longitudinal extent of said third arm, said first arm and said second arm having distal end portions extending above said third arm to form a saddle-shaped configuration.

12. The mounting element of claim 9, wherein said first arm, said second arm, and said third arm each have an arcuate cross section and cooperate to define a generally cylindrical body proximate said central base.

13. The mounting element of claim 12, wherein said first arm and said second arm extend from opposed sides of said central base and said third arm extends from said central base between said first arm and said second arm.

14. The mounting element of claim 13, wherein said first arm and said second arm include leading edges and said third arm includes leading edges, said leading edges of said third arm abutting said leading edges of said first arm and said second arm.

15. The mounting element of claim 13, wherein said longitudinal extent of at least one of said first arm and said second arm is greater than the longitudinal extent of said third arm, said first arm and said second arm having distal end portions extending above a distal end of said third arm to cooperatively form a saddle-shaped configuration.

16. The mounting element of claim 9, wherein said first arm, said second arm, and said third arm cooperate to define a generally tubular body proximate said central base.

17. The mounting element as defined in claim 9, wherein said central base is substantially planar.

18. The mounting element as defined in claim 9, wherein said central base further includes an aperture for receiving a portion of the triggering member.

19. The mounting element as defined in claim 9, wherein said central base further includes a second recess, said second recess defining said seat for seating a portion of the triggering member on said central base.

20. A sprinkler head for a fire extinguishing system for selectively discharging fluid onto a covered area, said sprinkler head comprising:

a base adapted for connection to a pressurized source of fluid, said base including a bore, said bore defining a passageway through said base and an opening to said passageway;

a frame attached to said base;

a deflector attached to said frame and positioned for deflecting the discharging fluid discharging from the sprinkler head;

a seal element selectively mounted on said base, said seal element having a closed position in which said seal element closes and seals said opening of said base;

a thermally activated triggering member selectively disposed between said frame and said seal element, said thermally activated triggering member holding said seal element in said closed position and being adapted to yield at a predetermined ambient temperature thereby releasing said seal element from said closed position; and a mounting element releasably coupling said triggering member to said frame, said mounting element comprising a central base having a first face and a second face, a first pair of arms each having a longitudinal extent, said first pair of arms extending from said first face at an angle less than 180 degrees, a second pair of arms having a longitudinal extent, said second pair of arms extending from said first face at an angle less than 180 degrees, at least one of said arms having a longitudinal extent greater than the longitudinal extent of at least one other of said arms, and said central base including a seat supporting said triggering member.

21. The sprinkler head as defined in claim 20, wherein said arms of said mounting element and said central base of said mounting element are of generally uniform thickness, and said arms are each joined to said central base by a bend.

22. The sprinkler head as defined in claim 20, wherein said longitudinal extent of said first pair of arms is greater than said longitudinal extent of said second pair of arms of said mounting element, said first pair of arms having distal end portions extending above said second pair of arms, and said distal end portions forming a saddle configuration and engaging said frame.

23. The sprinkler head as defined in claim 22, wherein said frame includes planar side portions, said first pair of arms engaging said planar side portions and interlocking said mounting element with said frame.

24. The sprinkler head as defined in claim 22, wherein said first pair of arms and said second pair of arms cooperate to define a tubular body proximate said central base.

25. The sprinkler head as defined in claim 24, wherein said frame includes an inner surface facing said central base and an outer surface opposite from said inner surface, said inner surface including a recess cooperating with and interlocking said mounting element with said frame.

26. The sprinkler head as defined in claim 25, wherein said recess is generally channel shaped having spaced-apart planar side walls, said planar side walls being spaced apart a distance greater than a width of each of said first pair of arms.

27. The sprinkler head as defined in claim 26, wherein said distance of said spaced-apart side walls is less than a width of said tubular body, said first pair of arms straddling said frame, and said second pair of arms abutting said inner surface of said frame to space said triggering member from said frame.

28. The sprinkler head as defined in claim 22, wherein frame includes planar side portions, said first pair of arms engaging said planar side portions for interlocking said mounting element with said frame.

* * * * *

UNITED STATES PATENT AND TRADEMARK OFFICE

CERTIFICATE OF CORRECTION

PATENT NO. : 5,826,665
DATED : October 27, 1998
INVENTORS : Perin E. Truax and James G. Retzloff It is certified that error appears in the above-identified patent and that said Letters Patent is hereby corrected as shown below:

Column 7, line 37:
"orientation" should be --the orientation--.

Column 8, line 19:
"spacing said central" should be --spacing said central base--.

Signed and Sealed this

Thirtieth Day of November, 1999

*Attest:*

*Attesting Officer*

Q. TODD DICKINSON

*Acting Commissioner of Patents and Trademarks*